US007310030B2

(12) United States Patent
Tsai et al.

(10) Patent No.: US 7,310,030 B2
(45) Date of Patent: Dec. 18, 2007

(54) RING MILLIMETER-WAVE FILTER HAVING AN EMBEDDED MICROSTRIP STRUCTURE

(75) Inventors: Ming-Lung Tsai, Taipei (TW); Tian-Wei Huang, Taipei (TW); Jia-Chuan Lu, Taipei (TW)

(73) Assignee: National Taiwan University, Taipei (TW)

( * ) Notice: Subject to any disclaimer, the term of this patent is extended or adjusted under 35 U.S.C. 154(b) by 61 days.

(21) Appl. No.: 11/218,644

(22) Filed: Sep. 6, 2005

(65) Prior Publication Data

US 2007/0052501 A1 Mar. 8, 2007

(51) Int. Cl.
*H01P 1/203* (2006.01)

(52) U.S. Cl. ..... 333/204; 333/205; 333/219

(58) Field of Classification Search ..... 333/204, 333/205, 219

See application file for complete search history.

(56) References Cited

U.S. PATENT DOCUMENTS 5,172,084 A * 12/1992 Fiedziuszko et al. ..... 333/204
6,121,861 A * 9/2000 Yabuki et al. ..... 333/204
6,958,667 B2 * 10/2005 Mizoguchi et al. ..... 333/204

* cited by examiner

*Primary Examiner*—Benny Lee
(74) *Attorney, Agent, or Firm*—Rosenberg, Klein & Lee

(57) ABSTRACT

A ring millimeter-wave filter is a three-dimensional dual-mode ring filter. The ring millimeter-wave filter makes use of a three-dimensional coupling architecture as the feed of a filter to conquer the limit of the smallest spacing of a planar circuit made by the low-temperature cofired ceramic (LTCC) process so as to achieve the required coupling. Moreover, through the design of an embedded microstrip line, more than 20% of the filter area can be saved to facilitate integration with other components.

8 Claims, 4 Drawing Sheets

RING MILLIMETER-WAVE FILTER HAVING AN EMBEDDED MICROSTRIP STRUCTURE

BACKGROUND OF THE INVENTION

1. Field of the Invention

The present invention relates to a ring millimeter-wave filter and, more particularly, to a ring millimeter-wave filter making use of an embedded microstrip line to realize a three-dimension architecture.

2. Description of Related art

Filters play an important role in the wireless communication area. The function of a filter is to pass signals in its pass band and to attenuate signals in its stop band. In other words, filters control the responses near a certain frequency of communication systems.

After the low-temperature cofired ceramic (LTCC) process has been presented to the public, it has been used to fabricate multi-layer substrates to reduce the whole circuit area. For instance, Taiwan Pat. App. No. 562250 "multi-layer ceramic lowpass filter" and U.S. Pat. App. No. 2005/0012567 A1 "lowpass filter formed in multi-layer ceramic" have disclosed this kind of technology to facilitate integration with more circuits. Moreover, because filters made of inductors and capacitors have a serious high-frequency parasitic effect, they are only suitable to applications in lower microwave bands. Because ring filters use a wavelength transmission line to select the frequency, they can apply to high-frequency or millimeter-wave bands. Moreover, because ring filters have two transmission zero points near their central frequency, they can completely filter out noise of nearby channels and thus are suitable for bandpass filtering applications.

Conventional planar ring filters use a planar edge coupled method for energy coupling, e.g., U.S. Pat. App. No. 2004/0257173 A1 "apparatus and methods for split feed coupled-ring resonator-pair elliptic-function filters" and U.S. Pat. No. 6,720,848 B2 "dual mode bandpass filter having coupled modes." For multi-layer package design, however, this planar architecture will occupy most of the surface area and thus is not suitable to small-area designs.

In the present invention, energy coupling of a multi-layer package three-dimensional structure is used to design a small-area ring filter. The present invention proposes a ring millimeter-wave filter making use of an embedded microstrip line to realize a three-dimensional architecture so as to solve the above problems in the prior art.

SUMMARY OF THE INVENTION

An object of the present invention is to propose a ring millimeter-wave filter, which makes use of a three-dimensional energy coupling method and an embedded microstrip line to reduce the whole filter circuit area so as to facilitate integration with other active and passive circuits.

Another object of the present invention is to provide a ring millimeter-wave filter, which makes use of the low-temperature cofired ceramic technology to fabricate multi-layer three-dimensional coupling capacitors so as to reduce the ring filter area, hence accomplishing the effect of system packaging.

To achieve the above objects, a ring millimeter-wave filter of the present invention is made by the low-temperature cofired ceramic (LTCC) multi-layer process. The ring millimeter-wave filter comprises a signal input electrode, a signal output electrode, at least two coupling capacitors, an embedded microstrip line ring, and a perturbation source.

The signal input electrode is used for receiving an external signal to be processed. The signal output electrode is used for outputting the processed signal. The magnitudes of coupling capacitance of the coupling capacitors are determined according to the overlap area of an upper metal microstrip line and a lower metal layer electrically connected with the signal input electrode and the signal output electrode, respectively. The embedded microstrip line ring is connected to the lower metal layer. The signal is coupled from the signal input electrode to the embedded microstrip line ring or from the embedded microstrip line ring to the signal output electrode via the coupling capacitors. The perturbation source is located intermediately between the signal input electrode and the signal out electrode and connected to the embedded microstrip line ring. The perturbation source is used to make two orthogonal modes produce coupling so as to excite the required frequency band and bandwidth.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

In the present invention, a ring filter conventionally realized in a mono-layer substrate is fabricated by means of the low-temperature cofired ceramic (LTCC) multi-layer substrate process to simplify the whole design flow and also reduce the whole circuit area, hence facilitating integration with other active and passive components. The present invention accomplishes area reduction by means of three dimensional coupling. The present invention uses an embedded microstrip line ring whose effective wavelength, due to its larger dielectric constant, is smaller than that of a microstrip line ring. The whole circuit area can therefore be reduced.

Figure 1:
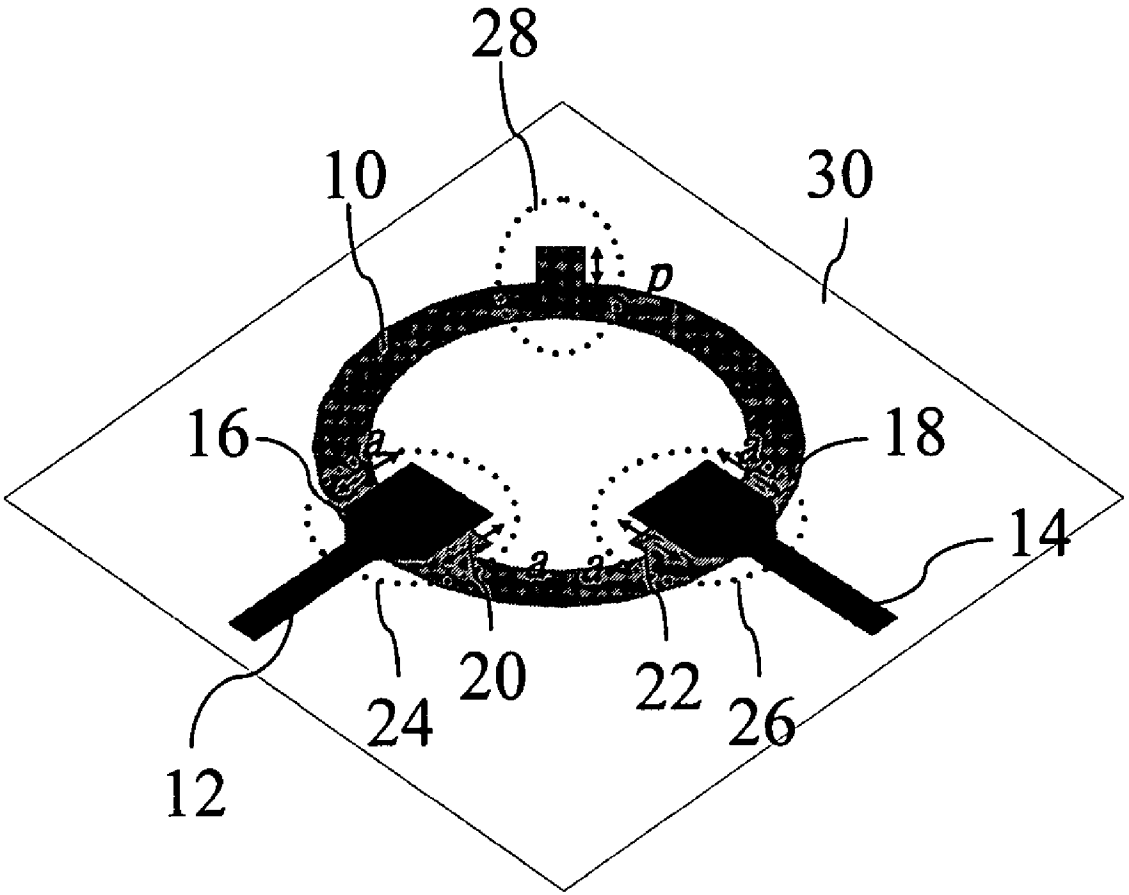
FIG. 1 is a structure diagram of a ring millimeter-wave filter of the present invention.
Figure 2:
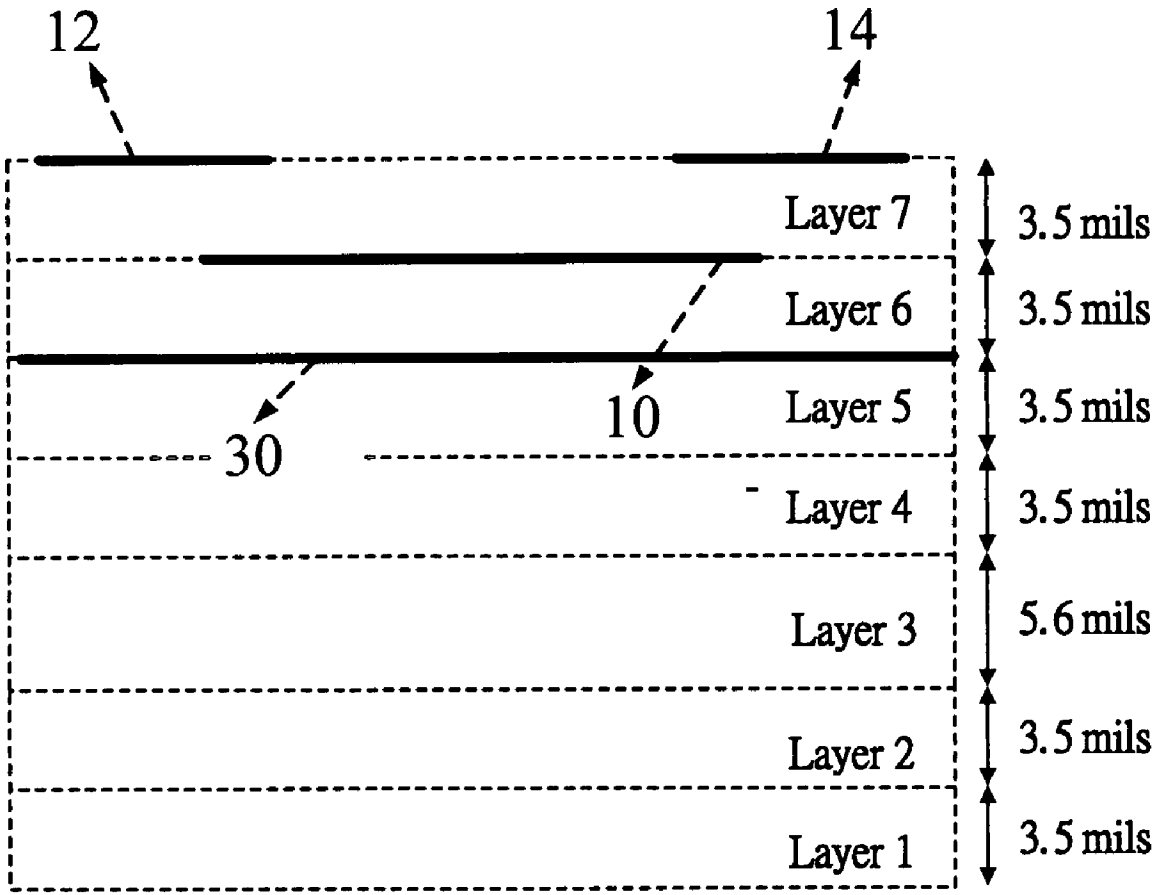
FIG. 2 is a side cross-sectional view of a ring millimeter-wave filter of the present invention.

A ring millimeter-wave filter of the present invention is mainly divided into three parts: an electrode part, a ring part, and a perturbation part. As shown in FIGS. 1 and 2, the circumference of an embedded microstrip line ring 10 at layer 6(see FIG. 2) is a wavelength. A signal input electrode 12 and a signal output electrode 14 at layer 7 (see FIG. 2) are used to receive an external signal to be processed and output the processed signal, respectively. As shown in FIG. 1, upper metal microstrip lines 16 and 18 extend from the two electrodes 12 and 14, respectively. Two coupling capacitors 24 and 26 are formed at the overlap regions between lower metal layers 20 and 22 extending from the embedded microstrip line ring 10 and the upper metal microstrip lines 16 and 18. The magnitudes of coupling capacitance of the coupling capacitors can be determined according to the overlap area of the upper metal microstrip lines 16 and 18 and the lower metal layers 20 and 22. A perturbation source 28 is located intermediately between the signal input electrode 12 and the signal output electrode 14 and extends from the embedded microstrip line ring 10. The perturbation source 28 is used to make two orthogonal modes produce coupling so as to excite the required frequency band and bandwidth. Using the above thee dimensional structure, the signal is coupled from the signal input electrode 12 to the embedded microstrip line ring 10 via the coupling capacitor 24 or from the embedded microstrip line ring 10 to the signal output electrode 14 via the coupling capacitor 26.

The signal input electrode 12 and the signal output electrode 14 are orthogonal to each other. The conductive layer immediately below the ring structure, i.e., layer 5 (of the layers 1,2,3,4,5,6, and 7, illustrated in FIG. 2), is a ground layer 30 (see FIGS. 1 and 2). In the present invention, the length P (see FIG. 1) of the perturbation source 28 can be changed to change the degree of perturbation so as to vary the central frequency and bandwidth.

An important aspect of the design of the three dimensional ring filter is the coupling between the input terminal and the output terminal. The magnitude of coupling is determined by the overlap between the upper and lower metal layers (layer 6 and layer 7). In order to increase the coupling, the upper metal microstrip lines 16 and 18 at layer 7 and the lower metal layers 20 and 22 at layer 6 have a certain overlap area. As shown in FIG. 1, the length a of the upper metal microstrip lines 16 and 18 is adjusted to achieve the required coupling of the present invention, In practical designs, the required effective wavelength of the embedded microstrip line ring 10 is first designed according to the desired working frequency. Next, the required coupling capacitors 24 and 26 are designed and calculated out by means of three dimensional coupling. The perturbation source 28 is also added to excite the required pass band. The signal input electrode 12 and the signal output electrode 14 are then placed with a spacing of a quarter wavelength, and the perturbation source 28 is placed intermediately between the signal input electrode 12 and the signal output electrode 14. The direction of energy transfer is from the signal input electrode 12 via the coupling capacitor 24 to the embedded microstrip line ring 10, and then via the coupling capacitor 26 to the signal output electrode 14.

Figure 3:
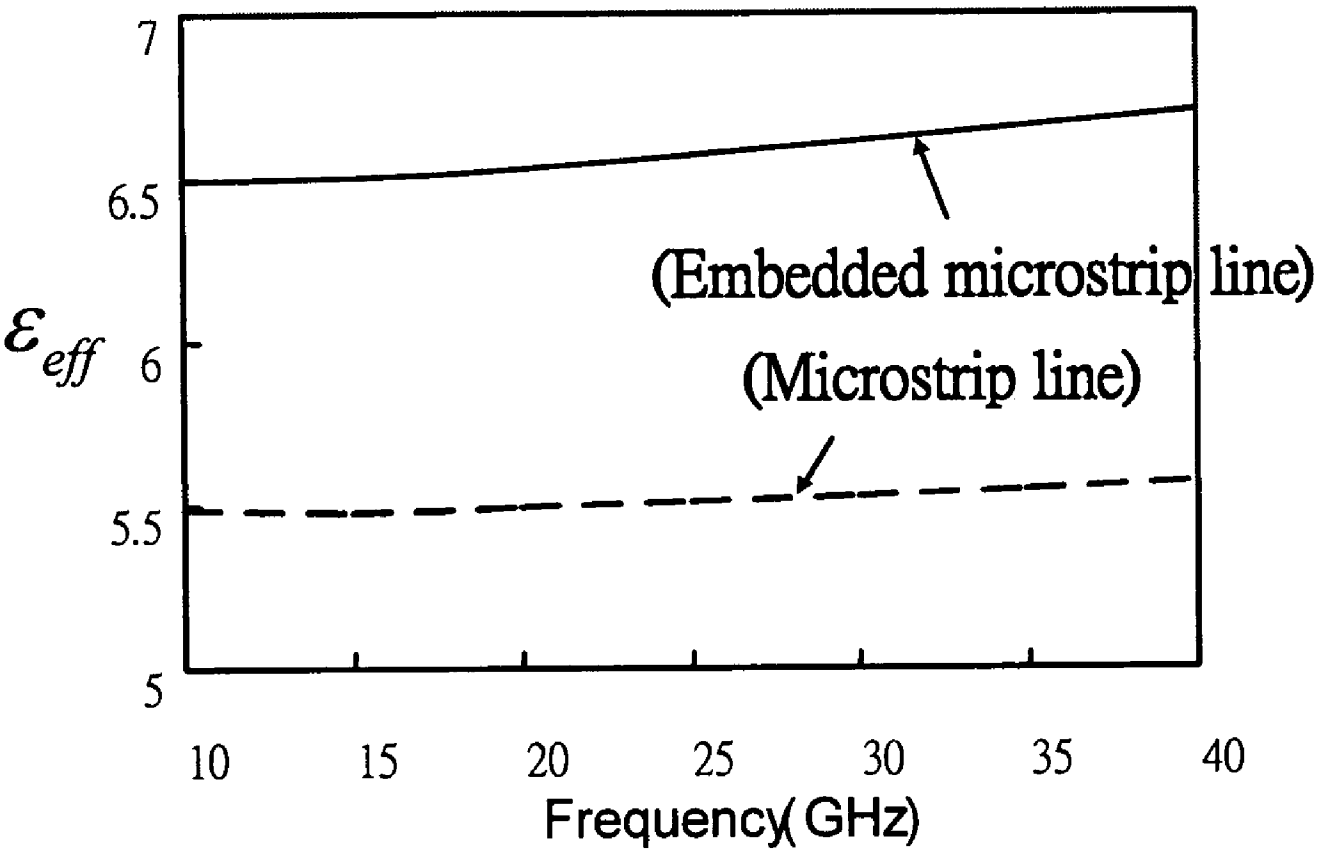
FIG. 3 is a comparison diagram of the effective dielectric constants of an embedded microstrip line of the present invention and an ordinary microstrip line.

As shown in FIG. 3, because the effective dielectric constant (i.e., $\epsilon_{eff}$ for a given Frequency (GHz)) of the embedded microstrip line is larger than that of ordinary microstrip line, its wavelength is smaller than that of ordinary microstrip line by about 10%. The filter designed with this wavelength can reduce the whole area by about 20%.

Figure 4:
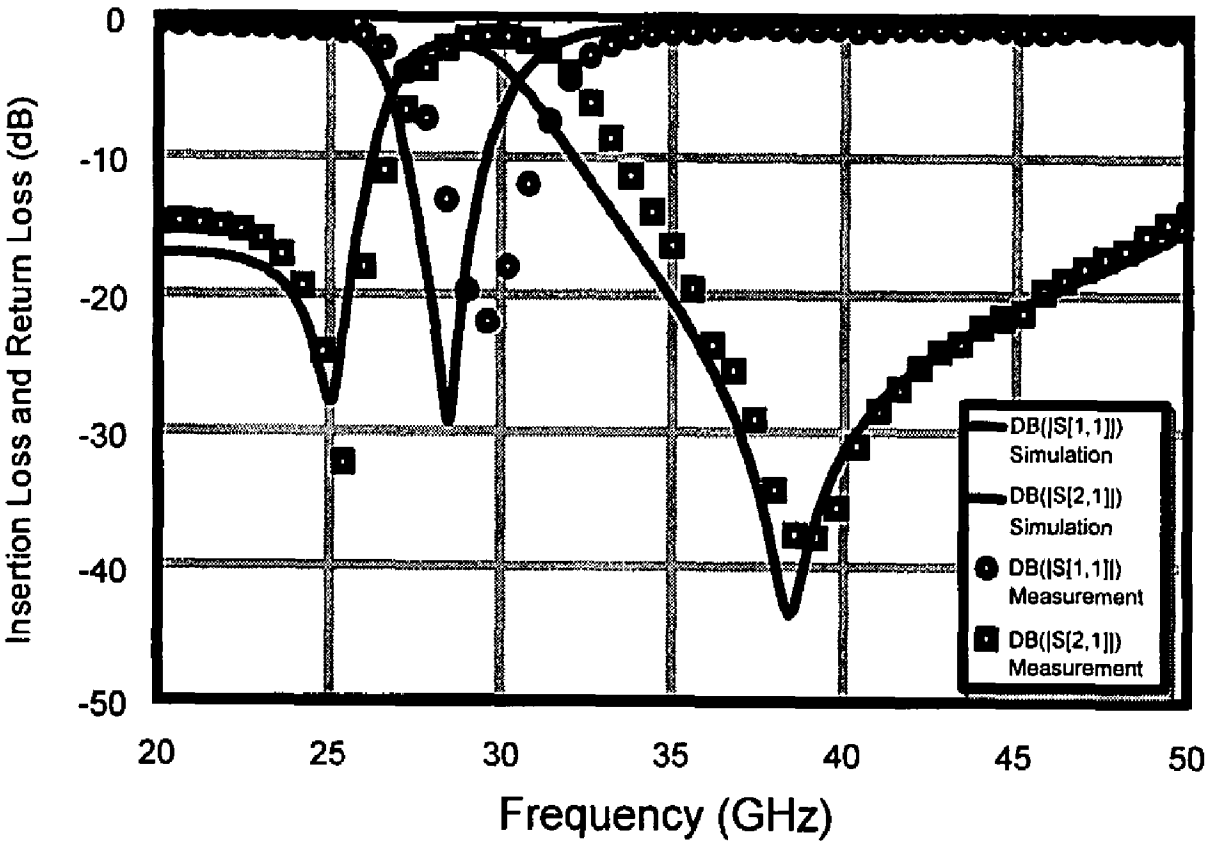
FIG. 4 is a diagram showing the simulation and measurement results of a ring millimeter-wave filter of the present invention.

To exemplify the effect of the present invention, a 3-D LTCC ring filter is made by Formosa Teletek Corporation. The LTCC process has a line-width limit of 3 mils. The thickness of each layer is 3.5 mils as shown in FIG. 2. The dielectric constant of the substrate is 7.8. The loss tangent at 10 GHz is 0.015. The software of Agilent ADS 2003 Momentum is used to simulate this architecture. Illustrative simulation and measurement results {i.e DB(|S(1, 1)|), DB(S|S(2, 1)|)} are shown in FIG. 4 comparing the insertion/return loss resulting at various frequencies under different operating conditions. During measurement, TRL calibration is used to eliminate the GSG contact effect. As can be known from FIG. 4, the measured insertion loss is 1.5 dB, the bandwidth is 7.5% (2.25 GHz), and the return loss is 12 dB.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A ring millimeter-wave filter made by a low-temperature cofired ceramic multi-layer process, said ring millimeter-wave filter comprising:

a signal input electrode for receiving an external signal to be processed;

a signal output electrode for outputting said processed signal;

at least two coupling capacitors, the magnitudes of coupling capacitance of said at least two coupling capacitors being determined according to overlap areas of respective upper metal microstrip lines formed on an outer surface of the filter and corresponding lower metal layer portions embedded therebeneath, said upper microstrip lines being electrically connected with said signal input electrode and said signal output electrode, respectively;

an embedded microstrip line ring connected to said respective lower metal layer portion, said signal being coupled from said signal input electrode to said embedded microstrip line ring or from said embedded microstrip line ring to said signal output electrode via said at least two coupling capacitors; and a perturbation source located intermediately between said signal input electrode and said signal output electrode along said embedded microstrip line ring.

2. The ring millimeter-wave filter as claimed in claim 1, wherein said at least two coupling capacitors are adjustable in capacitance responsive to said respective lower metal layer portion being adjusted in said overlap area with said corresponding upper metal microstrip line to achieve the required coupling so as to facilitate signal transmission.

3. The ring millimeter-wave filter as claimed in claim 1, wherein said embedded microstrip line ring has a larger effective dielectric constant to achieve a smaller effective wavelength.

4. The ring millimeter-wave filter as claimed in claim 1, wherein a size of said perturbation source controls the coupling of energies of two modes to determine the bandwidth and insertion loss.

5. The ring millimeter-wave filter as claimed in claim 1, wherein a length of said perturbation source is proportional to the magnitude of perturbation.

6. The ring millimeter-wave filter as claimed in claim 1, wherein a nearest conductive layer below said embedded microstrip line ring is a ground layer.

7. The ring millimeter-wave filter as claimed in claim 1, wherein the circumference of said embedded microstrip line ring is determined according a working frequency to determine the effective wavelength.

8. The ring millimeter-wave filter as claimed in claim 1, wherein said signal input electrode and said signal output electrode are orthogonal to each other.

* * * * *